US010118410B2

(12) United States Patent
Hamada

(10) Patent No.: US 10,118,410 B2
(45) Date of Patent: Nov. 6, 2018

(54) MEDIUM SUPPORT UNIT AND PRINTING APPARATUS

(71) Applicant: SEIKO EPSON CORPORATION, Tokyo (JP)

(72) Inventor: Nobuhiko Hamada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/447,387

(22) Filed: Mar. 2, 2017

(65) Prior Publication Data

US 2017/0253054 A1 Sep. 7, 2017

(30) Foreign Application Priority Data

Mar. 7, 2016 (JP) ..... 2016-043614

(51) Int. Cl.

| | |
|---|---|
| ***B41J 11/00*** | (2006.01) |
| ***B41J 3/407*** | (2006.01) |
| ***B41J 11/06*** | (2006.01) |
| ***B41J 11/02*** | (2006.01) |

(52) U.S. Cl.
CPC ..... *B41J 11/002* (2013.01); *B41J 3/4078* (2013.01); *B41J 11/02* (2013.01); *B41J 11/06* (2013.01)

(58) Field of Classification Search
CPC ..... B41J 11/002; B41J 11/06; B41J 3/4078
See application file for complete search history.

(56) References Cited

U.S. PATENT DOCUMENTS

| | | | | |
|---|---|---|---|---|
| 6,375,318 | B1 | 4/2002 | Johnson | |
| 2005/0117009 | A1 | 6/2005 | Kawaguchi et al. | |
| 2009/0079795 | A1* | 3/2009 | Motoharu | B41J 11/002 347/56 |

FOREIGN PATENT DOCUMENTS

| | | | | |
|---|---|---|---|---|
| JP | 07-053075 | A | | 2/1995 |
| JP | 2001-114439 | A | | 4/2001 |
| JP | 2005-161583 | A | | 6/2005 |
| JP | 2009-233858 | A | | 10/2009 |
| JP | 2009-279877 | A | | 12/2009 |
| JP | 2013159059 | A | * | 8/2013 |
| JP | 2013230658 | A | * | 11/2013 |

* cited by examiner

*Primary Examiner* — Kristal Feggins
*Assistant Examiner* — Kendrick Liu
(74) *Attorney, Agent, or Firm* — Workman Nydegger

(57) ABSTRACT

A medium support unit for supporting a medium on which a printing apparatus performs printing includes a support portion having a support surface for supporting the medium, a heating portion heating the support portion, and a main body portion on which the support portion is mounted, wherein heat conductivity of a mounting portion as a portion of the main body portion on which the support portion is mounted is lower than heat conductivity of the support portion.

12 Claims, 10 Drawing Sheets

MEDIUM SUPPORT UNIT AND PRINTING APPARATUS

BACKGROUND

1. Technical Field

The present invention relates to a medium support unit and a printing apparatus.

2. Related Art

Various existing printing apparatuses have been used. Among the printing apparatuses, a printing apparatus having the configuration in which a medium is supported on a support surface of a support portion of a medium support unit and printing is performed while the medium support unit is moved relative to a printing portion has been used.

For example, JP-A-2005-161583 discloses an ink jet image formation apparatus (printing apparatus) having the configuration in which a medium is supported on an operation surface of a placement base of a medium support unit and printing is performed while the medium support unit is moved relative to an ink jet head as a printing portion. The ink jet image formation apparatus disclosed in JP-A-2005-161583 includes a heat gun that heats and dries ink discharged onto the medium supported on the operation surface and JP-A-2005-161583 describes that the placement base itself may be a hot plate as a heating unit.

The printing apparatus including the heating unit is configured like the printing apparatus disclosed in JP-A-2005-161583, thereby heating and drying ink and so on. With this, preferable operation efficiency is provided. However, in the printing apparatus having the configuration in which the medium is supported on the medium support unit and printing is performed while the medium support unit is moved relative to the printing portion, the overall medium support unit is increased in temperature and operation efficiency of an operation involving contact with the medium support unit is lowered in some cases depending on the configuration of the heating unit.

SUMMARY

An advantage of some aspects of the invention is to improve operation efficiency of an operation involving contact with a medium support unit capable of heating a support portion for a medium.

A medium support unit according to a first aspect of the invention supports a medium on which a printing apparatus performs printing and includes a support portion having a support surface for supporting the medium, a heating portion heating the support portion, and a main body portion on which the support portion is mounted, wherein heat conductivity of a mounting portion as a portion of the main body portion on which the support portion is mounted is lower than heat conductivity of the support portion.

With the aspect of the invention, the heating portion heating the support portion is included and the heat conductivity of the mounting portion of the main body portion is lower than the heat conductivity of the support portion. That is to say, the support portion can be heated while increase in a temperature of the main body portion is suppressed. Therefore, when an operation involving contact with the medium support unit capable of heating the support portion for the medium is performed, operation efficiency is improved by performing the operation while making contact with the main body portion.

In a medium support unit according to a second aspect of the invention, it is preferable that the main body portion have the mounting portion and a non-mounting portion as a portion other than the mounting portion, which are made of different materials, and the heat conductivity of the mounting portion be lower than heat conductivity of the non-mounting portion, in the first aspect of the invention.

With the aspect of the invention, the main body portion has the mounting portion and the non-mounting portion, which are made of the different materials, and the heat conductivity of the mounting portion is lower than the heat conductivity of the non-mounting portion. Therefore, increase in the temperature of the main body portion can be suppressed efficiently by locally lowering the heat conductivity of the mounting portion.

In a medium support unit according to a third aspect of the invention, it is preferable that the main body portion have the mounting portion and a non-mounting portion as a portion other than the mounting portion, which are made of the same material, in the first aspect of the invention.

With the aspect of the invention, the main body portion has the mounting portion and the non-mounting portion, which are made of the same material. Therefore, the main body portion can be configured easily.

In a medium support unit according to a fourth aspect of the invention, it is preferable that the main body portion be provided with a hollow portion between an outer circumferential surface of the main body portion and the heating portion, in any one of the first to third aspects of the invention.

With the aspect of the invention, the main body portion is provided with the hollow portion between the outer circumferential surface and the heating portion. Provision of the hollow portion makes heat insulation efficiency preferable, thereby heating the support portion while suppressing increase in the temperature of the main body portion particularly efficiently.

It is preferable that a medium support unit according to a fifth aspect of the invention include a frame portion capable of pressing the medium supported on the support portion by being mounted on a receiver provided on the main body portion, in any one of the first to fourth aspects of the invention.

With the aspect of the invention, the frame portion capable of pressing the medium supported on the support portion by being mounted on the receiver provided on the main body portion is included. Therefore, the medium can be supported on the support portion reliably and increase in the temperature of the frame portion mounted on the receiver can be suppressed by providing the receiver not on the support portion but on the main body portion.

In a medium support unit according to a sixth aspect of the invention, it is preferable that the support portion be made of a highly heat conductive material having higher heat conductivity than heat conductivity of a material forming the main body portion, in any one of the first to fifth aspects of the invention.

With the aspect of the invention, the support portion is made of the highly heat conductive material having higher heat conductivity than the heat conductivity of the material forming the main body portion. Therefore, the support portion can be heated efficiently.

It should be noted that the "material forming the main body portion" is not limited to the case in which one type of material forms the main body portion. When a plurality of types of materials form the main body portion, the "higher heat conductivity than the heat conductivity of the material forming the main body portion" indicates that the heat conductivity is higher than the heat conductivity of at least one material among the materials forming the main body portion.

Furthermore, there is no limitation on the "highly heat conductive material" but, for example, metal is preferably used.

In a medium support unit according to a seventh aspect of the invention, it is preferable that a heating region of the heating portion be divided on the support surface and a temperature be capable of being changed for every divided region, in any one of the first to sixth aspects of the invention.

With the aspect of the invention, the heating region of the heating portion is divided on the support surface and the temperature is capable of being changed for every divided region. Therefore, only a necessary region can be heated at an appropriate temperature, thereby heating the necessary region of the support surface while suppressing energy consumption.

A printing apparatus according to an eighth aspect of the invention includes the medium support unit according to any one of the first to seventh aspects of the invention and a printing portion that performs printing on the medium supported on the medium support unit.

With the aspect of the invention, the heating portion heating the support portion is included and the heat conductivity of the mounting portion of the main body portion is lower than the heat conductivity of the support portion. That is to say, the support portion can be heated while suppressing increase in the temperature of the main body portion. Therefore, when an operation involving contact with the medium support unit capable of heating the support portion for the medium is performed, operation efficiency can be improved by performing the operation while making contact with the main body portion.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a printing apparatus 1 according to an embodiment of the invention will be described in detail with reference to the accompanying drawings.

First Embodiment (FIG. 1 to FIG. 7)

Figure 1:
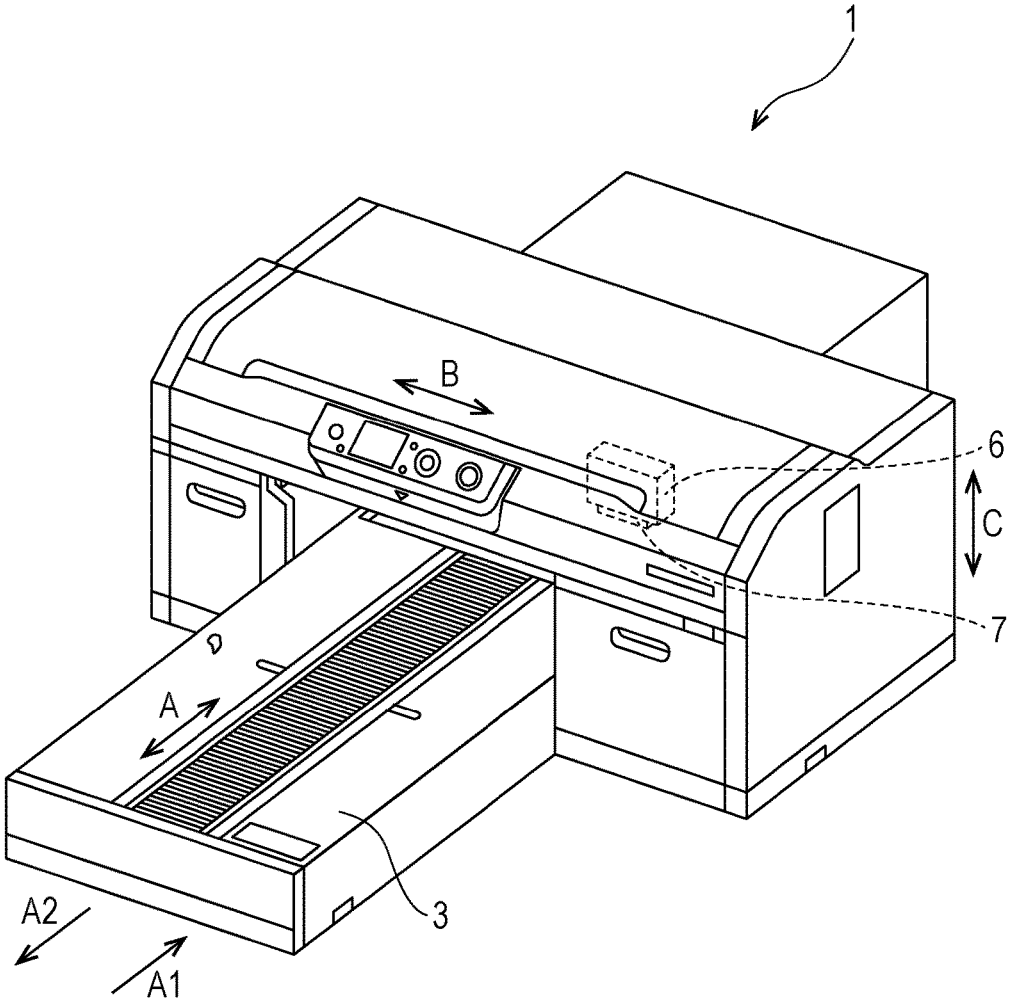
FIG. 1 is a schematic perspective view illustrating a printing apparatus according to a first embodiment of the invention.
Figure 2:
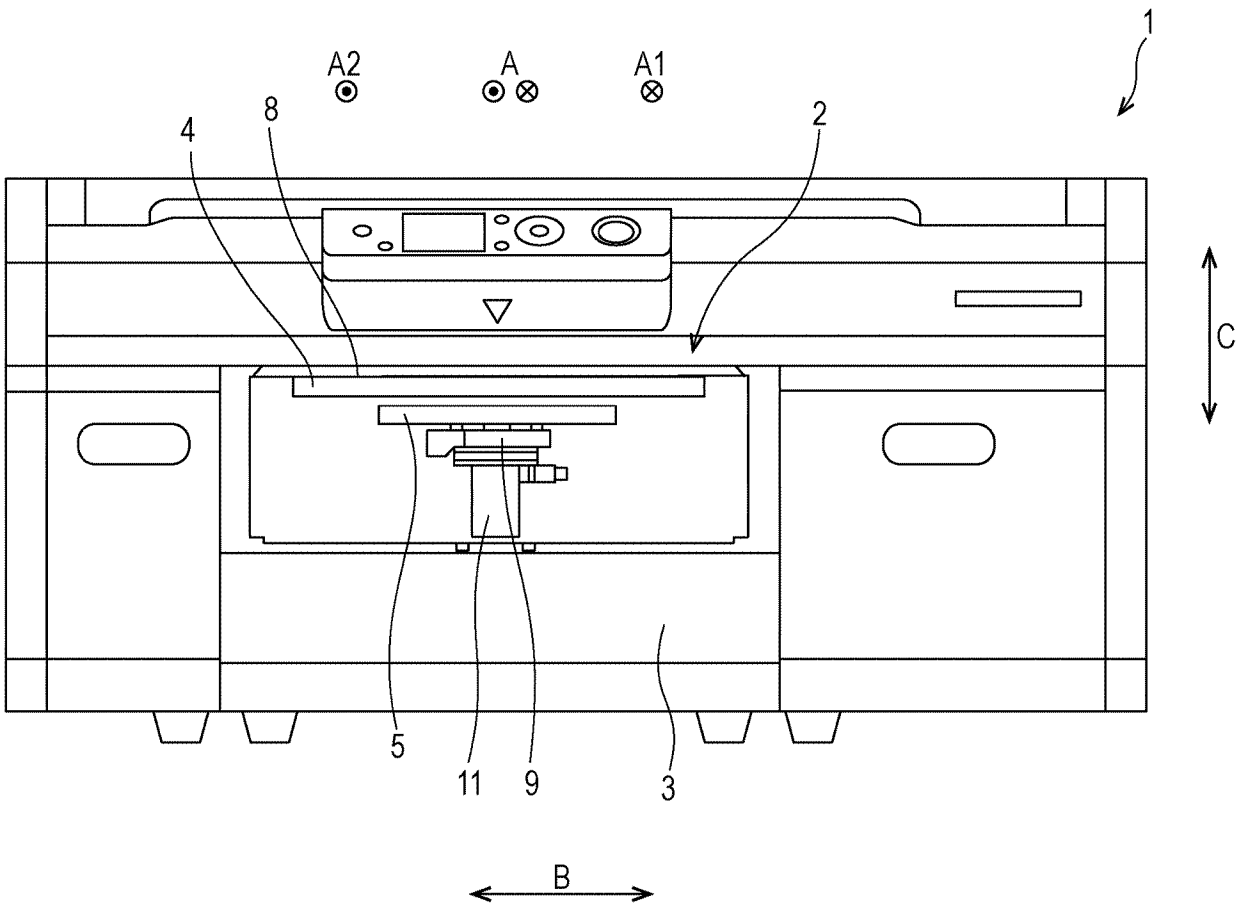
FIG. 2 is a schematic front view illustrating the printing apparatus in the first embodiment of the invention.
Figure 3:
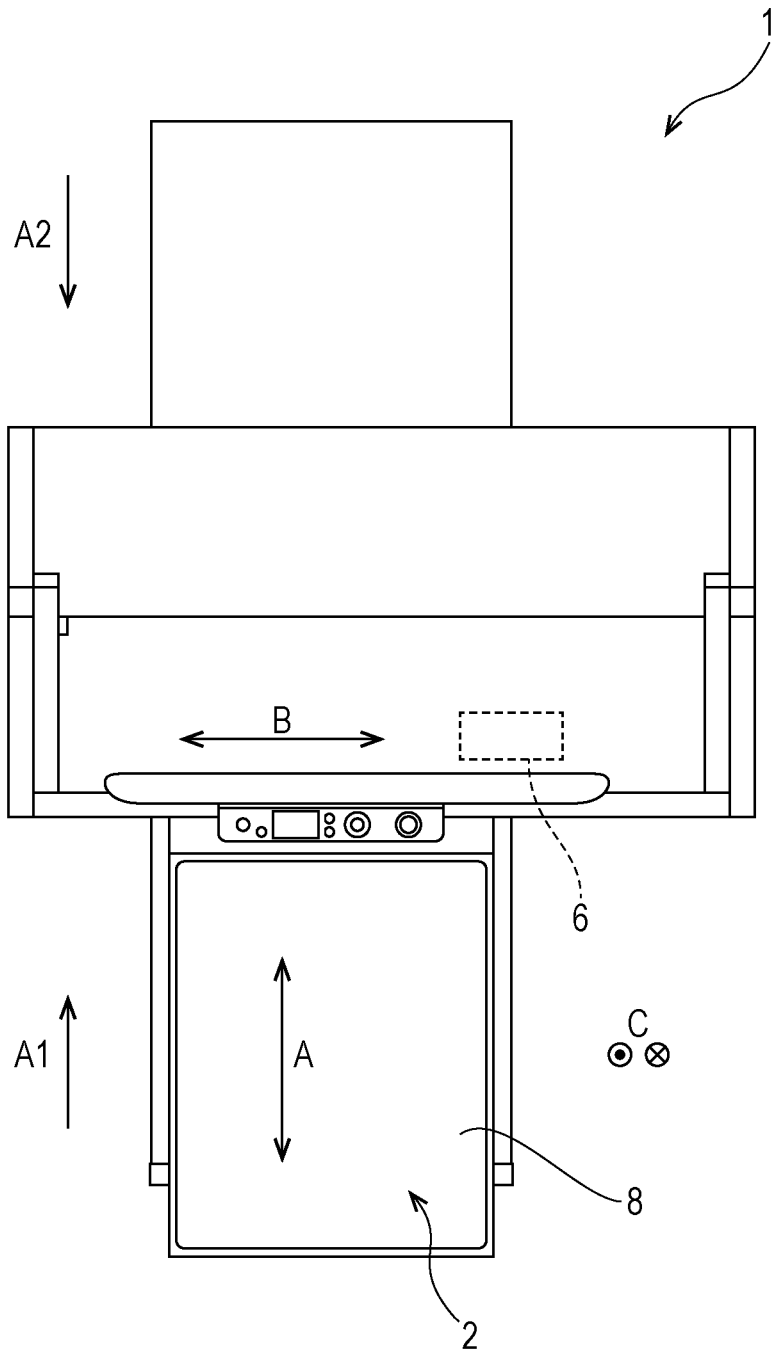
FIG. 3 is a schematic plan view illustrating the printing apparatus in the first embodiment of the invention.

FIG. 1 is a schematic perspective view of the printing apparatus 1 according to the embodiment and illustrates a state in which a medium support unit 2 is at a printing start position. FIG. 2 is a schematic front view of the printing apparatus 1 in the embodiment. FIG. 3 is a schematic plan view of the printing apparatus 1 in the embodiment and illustrates a state in which the medium support unit 2 is at a set position of a medium M (see FIG. 7). All of FIG. 1 to FIG. 3 illustrate some constituent members in a simplified manner.

The printing apparatus 1 in the embodiment includes the medium support unit 2 that is moved in a movement direction A in a state of supporting the medium M on a support surface 8 of a tray 4 as a support portion. Although the detail configuration will be described later, the medium support unit 2 includes the tray 4 having the support surface 8 supporting the medium M, a heater 13 (see FIG. 5 to FIG. 7) as a heating portion heating the tray 4, and a main body portion 14 (see FIG. 5) on which the tray 4 is mounted.

Furthermore, the printing apparatus 1 includes a medium transportation unit 3 that transports the medium supported on the tray 4 in the movement direction A. The movement direction A is a direction including a direction A1 and a direction A2 as a direction opposite to the direction A1.

The medium support unit 2 is placed on a stage 5 in a detachable manner. An attachment/detachment direction C of the medium support unit 2 to/from the stage 5 is a vertical direction of the printing apparatus 1 in the embodiment. The medium support unit 2 is moved in the direction (vertical direction) along the attachment/detachment direction C together with the stage 5 by rotating a lever 9. It should be noted that as illustrated in FIG. 2, the lever 9 is provided on an arm portion 11. As the medium M, various materials such as textile (woven fabric, fabric, or the like), paper, and vinyl chloride resin can be used.

Furthermore, a printing head 7 capable of discharging ink to perform printing on the medium M is provided in a main body of the printing apparatus 1. The printing apparatus 1 in the embodiment causes a carriage 6 on which the printing head 7 is provided to reciprocate in a scanning direction B intersecting with the movement direction A. With this, the printing apparatus 1 in the embodiment causes the printing head 7 to discharge the ink onto the medium M supported on the tray 4 to form a desired image while causing the printing head 7 to reciprocate in the scanning direction B.

As for the printing apparatus 1 in the embodiment, the front side (lower left direction) in FIG. 1 corresponds to the set position of the medium M onto the tray 4 (see FIG. 3). After the tray 4 onto which the medium M has been set is moved in the direction A1 of the movement direction A to a printing start position at the back side (upper right direction) in FIG. 1, printing is performed while moving the tray 4 in the direction A2 of the movement direction A.

It should be noted that although the printing apparatus 1 in the embodiment includes the printing head 7 which performs printing while reciprocating in the scanning direction B, the printing apparatus 1 in the embodiment may be a printing apparatus including a so-called line head in which a plurality of nozzles for discharging ink are provided in an intersection direction intersecting with the movement direction of the medium M.

The "line head" is a printing head that is used for a printing apparatus in which a nozzle region formed in the intersection direction intersecting with the movement direction of the medium M is provided so as to cover the overall intersection direction and which forms an image by relatively moving the printing head or the medium M. It should be noted that the nozzle region of the line head in the intersection direction may not be capable of covering the intersection directions of all of the media M supported by the printing apparatus.

Furthermore, although the printing head 7 in the embodiment is the printing portion capable of performing printing by discharging ink onto the medium M, the printing portion is not limited to this printing portion and, for example, a transfer-type printing portion that performs printing by transferring colorant onto the medium M may also be used.

Next, the electric configuration of the printing apparatus 1 in the embodiment will be described.

Figure 4:
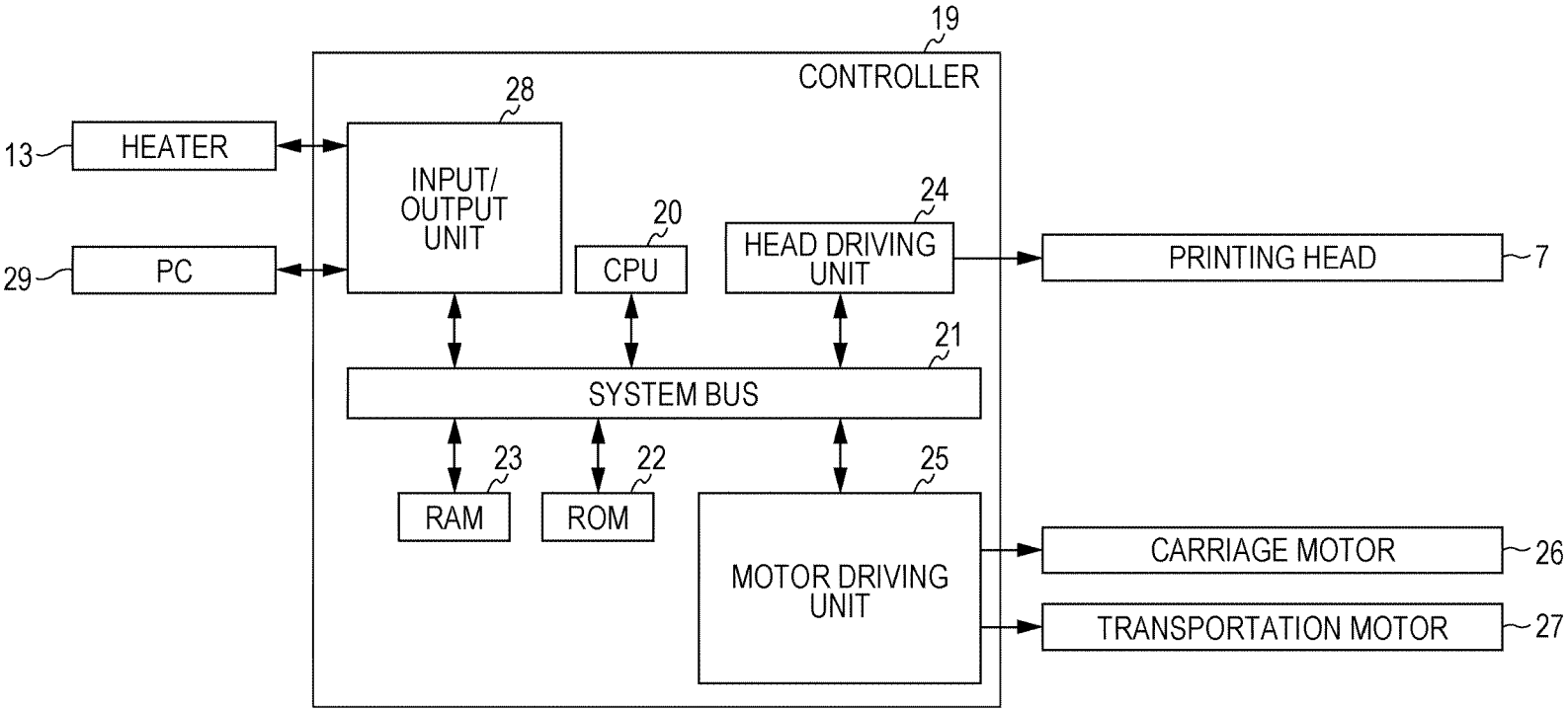
FIG. 4 is a block diagram of the printing apparatus in the first embodiment of the invention.

FIG. 4 is a block diagram of the printing apparatus 1 in the embodiment.

A central processing unit (CPU) 20 that controls overall the printing apparatus 1 is provided in a controller 19. The CPU 20 is connected to a read only memory (ROM) 22 storing therein various control programs and the like that the CPU 20 executes and a random access memory (RAM) 23 capable of temporarily storing therein data with a system bus 21 interposed therebetween.

Furthermore, the CPU 20 is connected to a head driving unit 24 for driving the printing head 7 with the system bus 21 interposed therebetween.

The CPU 20 is connected to a motor driving unit 25 with the system bus 21 interposed therebetween. The motor driving unit 25 is connected to a carriage motor 26 for moving the carriage 6 on which the printing head 7 is provided and a transportation motor 27 provided on the medium transportation unit 3 for transporting the medium M (that is, moving the medium support unit 2).

Furthermore, the CPU 20 is connected to an input/output unit 28 with the system bus 21 interposed therebetween. The input/output unit 28 is connected to the heater 13 and a personal computer (PC) 29 for transmitting and receiving data such as print data and signals.

Subsequently, the medium support unit 2 as a main part of the printing apparatus 1 in the embodiment will be described.

Figure 5:
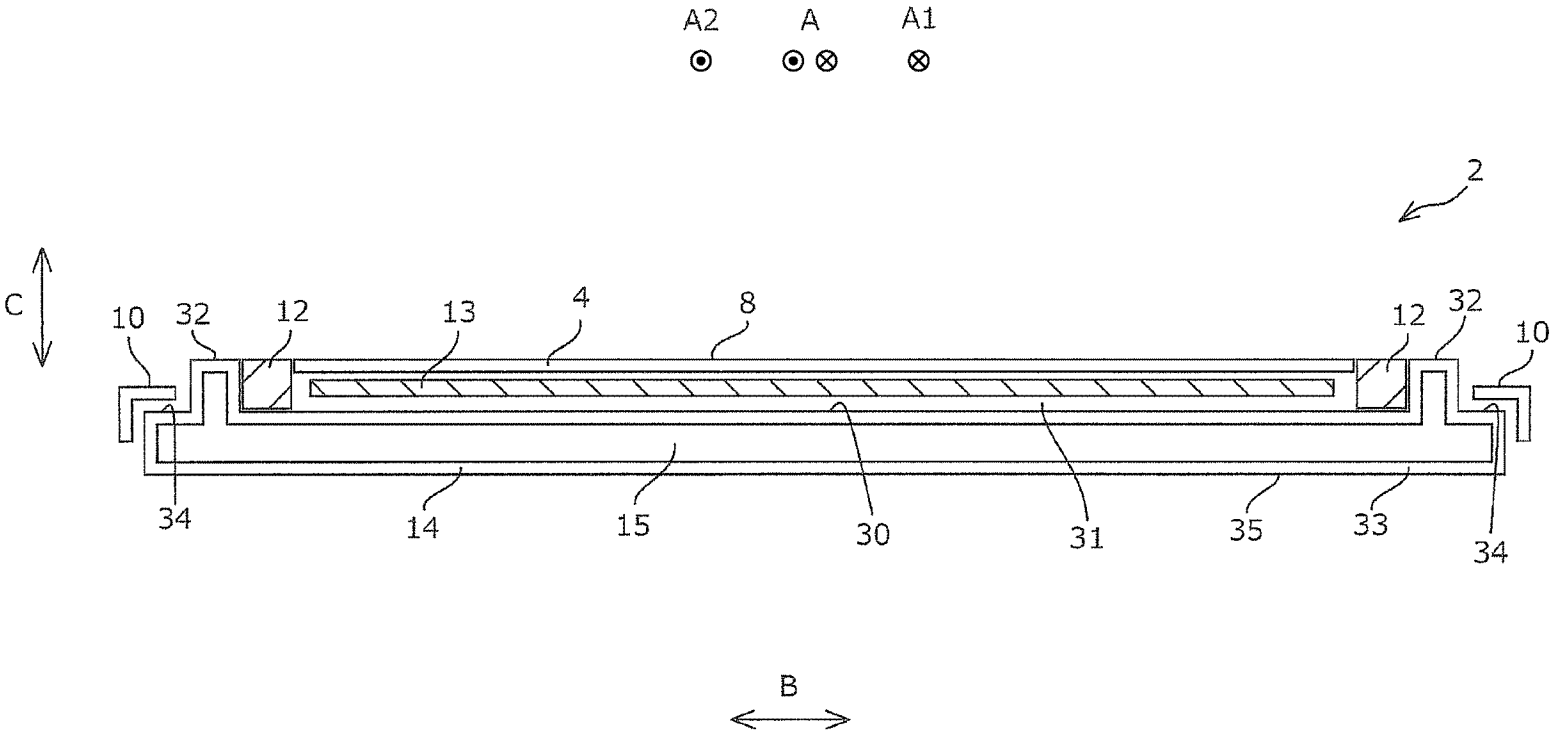
FIG. 5 is a schematic cross-sectional front view illustrating a main part of the printing apparatus in the first embodiment of the invention.
Figure 6:
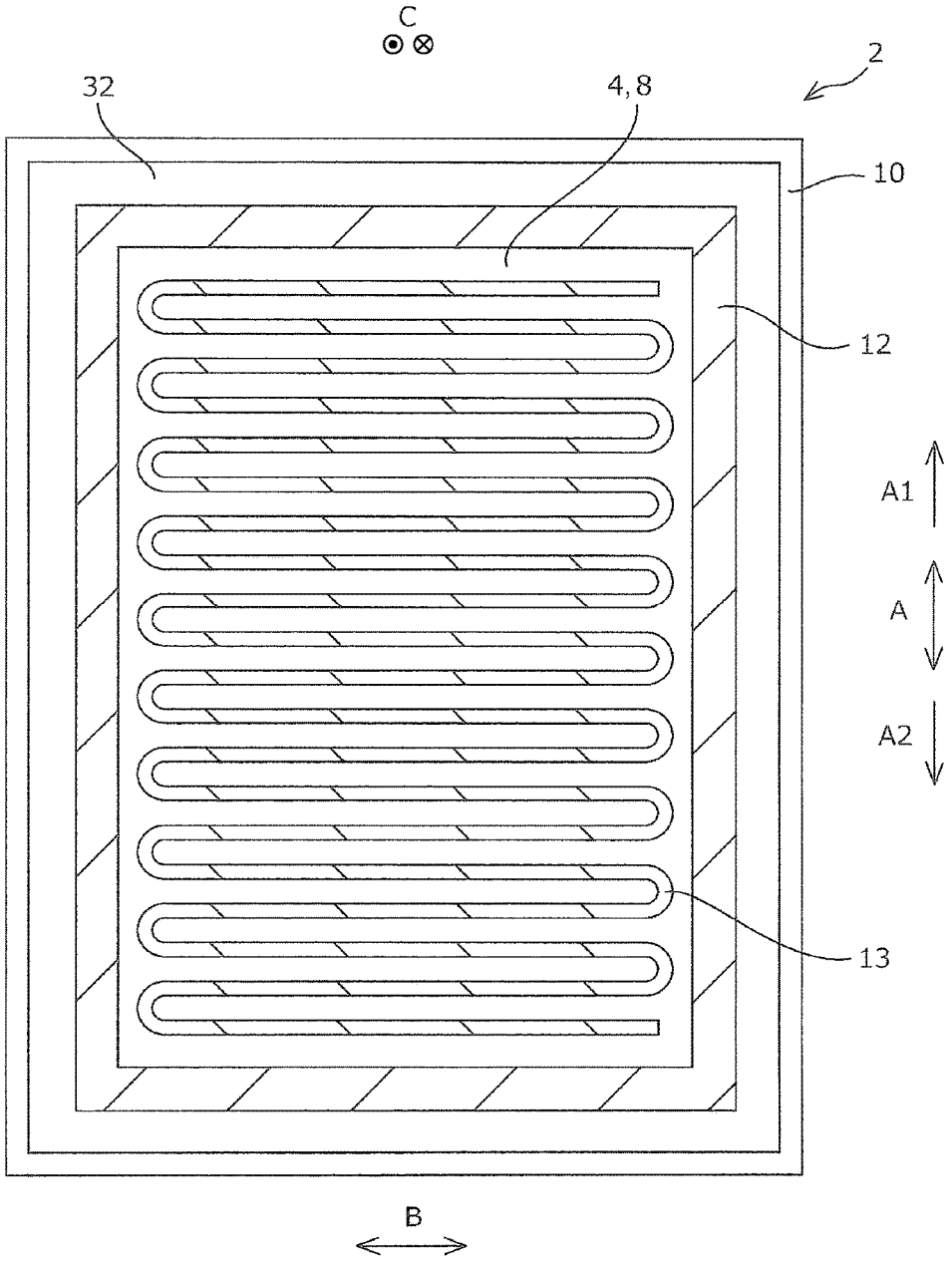
FIG. 6 is a schematic see-through plan view illustrating the main part of the printing apparatus in the first embodiment of the invention.
Figure 7:
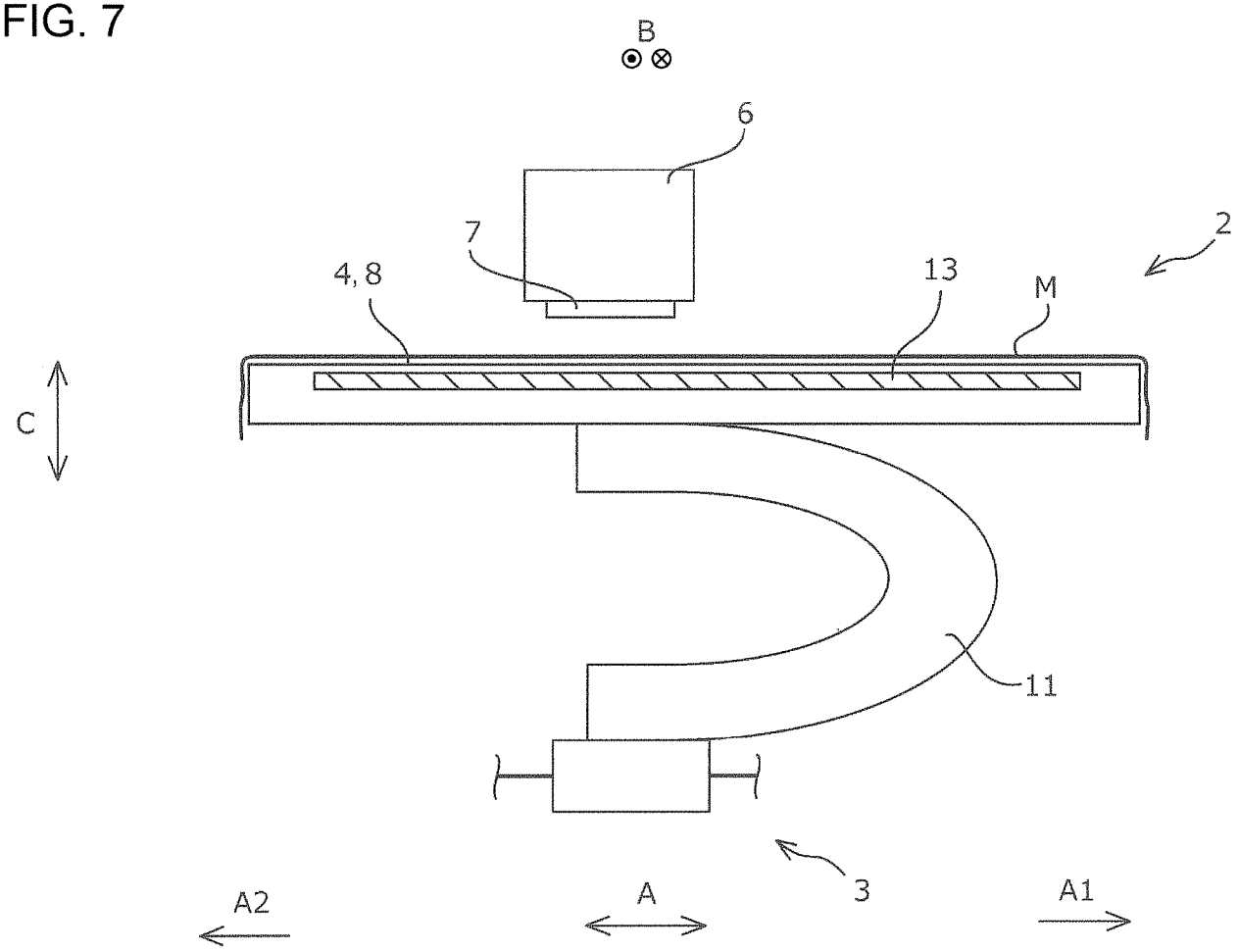
FIG. 7 is a schematic cross-sectional side view illustrating the main part of the printing apparatus in the first embodiment of the invention.

FIG. 5 illustrates a schematic cross-sectional front view of the medium support unit 2 as the main part of the printing apparatus 1 in the embodiment. FIG. 6 is a schematic see-through plan view of the medium support unit 2 of the printing apparatus 1 in the embodiment. FIG. 7 is a schematic cross-sectional side view including a peripheral portion of the medium support unit 2 in the printing apparatus 1 in the embodiment and illustrates a state in which the medium M has been set onto the medium support unit 2. It should be noted that FIG. 7 illustrates the configuration of the medium support unit 2, such as the configuration of the heater 13, in a simplified manner.

As illustrated in FIG. 5 to FIG. 7, the heater 13 capable of heating the tray 4 is provided in the medium support unit 2 in the embodiment. The medium support unit 2 in the embodiment is configured to be electrically connected to the printing apparatus 1 by being placed on the stage 5 and be capable of turning ON and OFF the heater 13 under control by the controller 19 when a user instructs to turn ON and OFF it using the PC 29 or the like. However, the configuration of the medium support unit 2 is not limited thereto and the medium support unit 2 may be configured to turn ON and OFF the heater 13 regardless of whether the medium support unit 2 is mounted on the printing apparatus 1 or not by, for example, providing a battery, a switch, or the like on the medium support unit 2.

As illustrated in FIG. 5, the main body portion 14 of the medium support unit 2 in the embodiment is provided with a hollow portion 15. Furthermore, the main body portion 14 is provided with a projecting portion 32 so as to surround the periphery at the upper surface side (see, FIG. 6) and a recess portion 31 is formed at the inner side of the projecting portion 32. A mounting portion 12 formed by a heat insulating member is provided so as to surround the inner periphery of the projecting portion 32 (an outer peripheral portion of the recess portion 31) (see FIG. 6). The mounting portion 12 is a portion of the main body portion 14 on which the tray 4 is mounted. The tray 4 is provided at the inner side of the mounting portion 12 (heat insulating member) in the recess portion 31 and the heater 13 is provided under the tray 4 (at the opposite side to the support surface 8). A surface 30 of the recess portion 31 at the side facing the heater 13 has a mirror surface structure.

The medium support unit 2 in the embodiment can heat the tray 4 efficiently and makes heat of the heater 13 difficult to be transferred to the main body portion 14 with this configuration. It should be noted that although as illustrated in FIG. 5, the main body portion 14 in the embodiment has the configuration in which the mounting portion 12 (heat insulating member) is placed on the bottom surface of the recess portion 31, it may have the configuration in which the mounting portion 12 (heat insulating member) is provided so as to penetrate through the bottom surface of the recess portion 31. With this configuration, the members are divided by the heat insulating member between the inner side and the outer side of the projecting portion 32. Therefore, it is more difficult to transfer the heat to the outer side of the projecting portion 32 in the main body portion 14.

To summarize the above description, the medium support unit 2 in the embodiment is a medium support unit supporting the medium M on which the printing apparatus 1 performs printing and includes the tray 4 having the support surface 8 supporting the medium M, the heater 13 heating the tray 4, and the main body portion 14 on which the tray 4 is mounted. The mounting portion 12 as the portion of the main body portion 14 on which the tray 4 is mounted is formed by the heat insulating member and the heat conductivity of the mounting portion 12 is therefore lower than the heat conductivity of the tray 4.

As described above, the medium support unit 2 in the embodiment includes the heater 13 heating the tray 4 and the heat conductivity of the mounting portion 12 of the main body portion 14 is lower than the heat conductivity of the tray 4. Therefore, the medium support unit 2 in the embodiment can heat the tray 4 while suppressing increase in the temperature of the main body portion 14. Accordingly, when an operation involving contact with the medium support unit 2 capable of heating the tray 4 as the support portion for the medium M is performed, operation efficiency can be improved by performing the operation while making contact with the main body portion 14.

In other words, the printing apparatus 1 in the embodiment includes the medium support unit 2 having the above-described configuration and the printing head 7 that performs printing on the medium M supported on the medium support unit 2.

As described above, the printing apparatus 1 in the embodiment includes the heater 13 heating the tray 4 and the heat conductivity of the mounting portion 12 of the main body portion 14 is lower than the heat conductivity of the tray 4. Therefore, the printing apparatus 1 in the embodiment can heat the tray 4 while suppressing increase in the temperature of the main body portion 14. Accordingly, when the operation involving contact with the medium support unit 2 capable of heating the tray 4 as the support portion for the medium M is performed, operation efficiency can be improved by performing the operation while making contact with the main body portion 14.

Furthermore, in the medium support unit 2 in the embodiment, the mounting portion 12 (heat insulating member) of the main body portion 14 is made of ceramics and a non-mounting portion 33 thereof as a portion other than the mounting portion 12 is made of metal. That is to say, the main body portion 14 in the embodiment has the mounting portion 12 and the non-mounting portion 33 as the portion other than the mounting portion 12, which are made of the different materials, and the heat conductivity of the mounting portion 12 is lower than the heat conductivity of the non-mounting portion 33. Therefore, increase in the temperature of the main body portion 14 is suppressed efficiently by locally lowering the heat conductivity of the mounting portion 12.

On the other hand, the main body portion 14 may have the mounting portion 12 and the non-mounting portion 33 as the portion other than the mounting portion 12, which are made of the same material. For example, both of the mounting portion 12 and the non-mounting portion 33 may be made of ceramics. With this configuration, the main body portion 14 can be configured easily. It should be noted that when the mounting portion 12 and the non-mounting portion 33 are made of the same material, the medium support unit can have the same configuration as that of the medium support unit 2 in the embodiment other than the material of the mounting portion 12.

The tray 4 in the embodiment is made of metal. The mounting portion 12 in the embodiment is made of ceramics and the non-mounting portion 33 is made of metal. It should be noted that they are not limited to be made of these materials. For example, the tray 4 may be made of metal (aluminum or the like) having high heat conductivity and the overall main body portion 14 (the mounting portion 12 and the non-mounting portion 33) may be made of metal having low heat conductivity (stainless, titanium, or the like). Furthermore, as the mounting portion 12 (heat insulating member), glass wool, rock wool, foamed glass, urethane, polystyrene (foamed polystyrene), or the like can also be used instead of ceramics.

In addition, the shape of the tray 4 is not particularly limited and a tray with holes, a mesh-like tray, or the like can also be used instead of the flat plate-shaped tray like the tray 4 in the embodiment. When the tray with holes, the mesh-like tray, or the like is used, it can transfer heat of the heater 13 to the medium M particularly efficiently.

Moreover, the heater 13 is not also particularly limited. Although a heating wire is used therefor in the embodiment, a heating unit having another configuration may be employed.

The medium support unit 2 in the embodiment is provided with the hollow portion 15 in the main body portion 14 as illustrated in FIG. 5. That is to say, it can be said that the main body portion 14 in the embodiment is provided with the hollow portion 15 between an outer circumferential surface 35 (see FIG. 5) of the main body portion 14 and the heater 13. Provision of the hollow portion 15 makes heat insulation efficiency preferable. Therefore, the medium support unit 2 in the embodiment can heat the tray 4 while suppressing increase in the temperature of the main body portion 14 particularly efficiently.

As illustrated in FIG. 5 and FIG. 6, the medium support unit 2 in the embodiment includes a frame portion 10 capable of pressing the medium M supported on the tray 4 by being mounted on a receiver 34 (see FIG. 5) that is provided in the main body portion 14. Therefore, the medium support unit 2 in the embodiment can support the medium M on the tray 4 reliably and can suppress increase in the temperature of the frame portion 10 that is mounted on the receiver 34 by providing the receiver 34 not on the tray 4 but on the main body portion 14.

As described above, the tray 4 in the embodiment is made of a highly heat conductive material (metal) having higher heat conductivity than the heat conductivity of the material (ceramics) forming the main body portion 14. Therefore, the medium support unit 2 in the embodiment can heat the tray 4 efficiently.

It should be noted that the "material forming the main body portion 14" is not limited to the case in which one type of material forms the main body portion. When a plurality of types of materials form the main body portion as in the embodiment (in the embodiment, the mounting portion 12 is made of ceramics and the non-mounting portion 33 is made of metal), the "higher heat conductivity than the heat conductivity of the material forming the main body portion 14" indicates that the heat conductivity is higher than the heat conductivity of at least one material (in the embodiment, ceramics) among the materials forming the main body portion 14.

Furthermore, there is no limitation on the "highly heat conductive material" but, for example, metal is preferably used.

Figure 8:
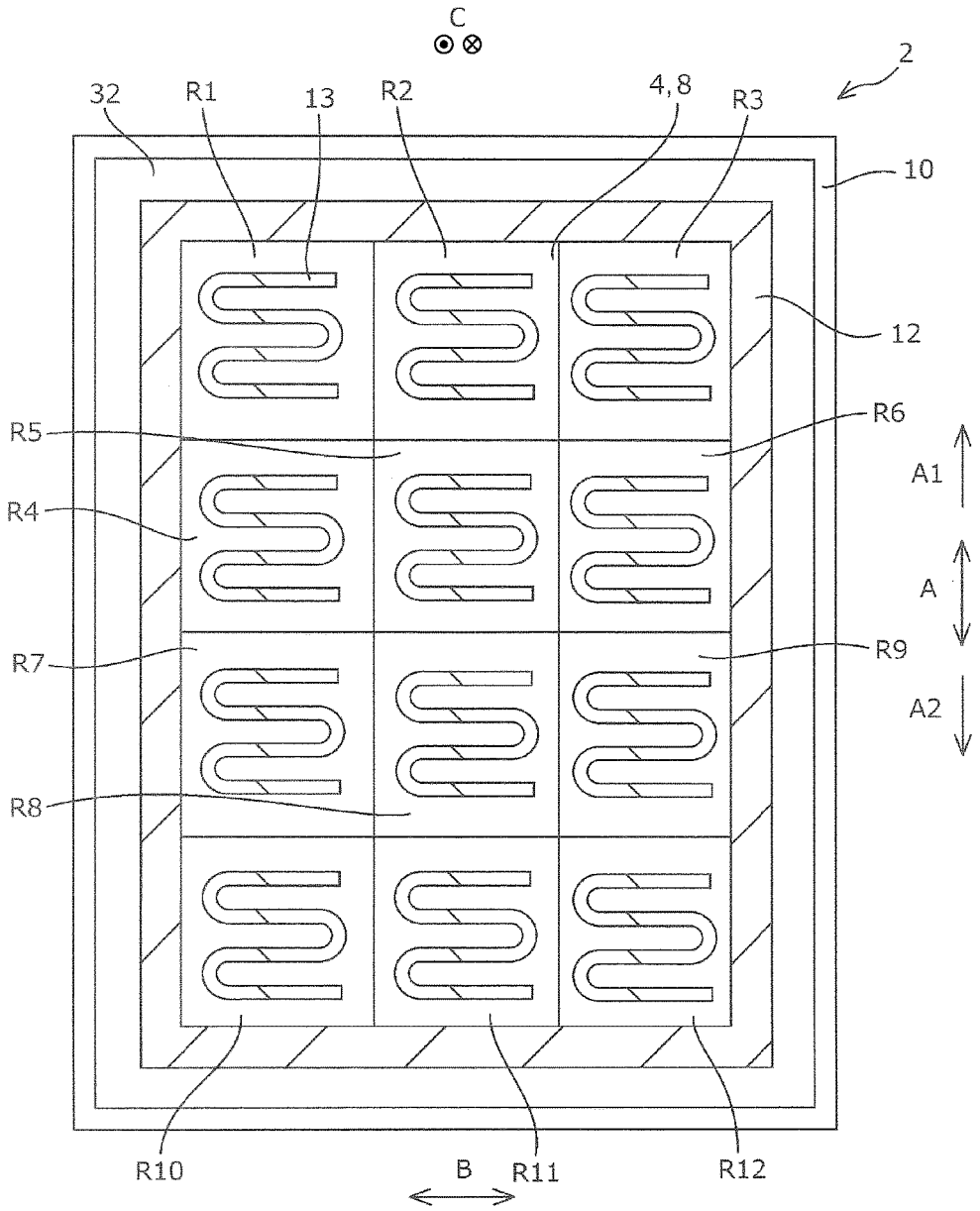
FIG. 8 is a schematic see-through plan view illustrating a main part of a printing apparatus according to a second embodiment of the invention.

Second Embodiment (FIG. 8)

Next, the printing apparatus 1 according to a second embodiment will be described in detail with reference to the accompanying drawing.

FIG. 8 is a schematic see-through plan view of the medium support unit 2 as a main part of the printing apparatus 1 in the second embodiment and is a view corresponding to FIG. 6 for the printing apparatus 1 in the first embodiment.

It should be noted that the printing apparatus 1 in the embodiment has the same configuration as that of the printing apparatus 1 in the first embodiment other than the configuration of the medium support unit 2 and the same reference numerals denote the same constituent members as those of the printing apparatus 1 in the first embodiment.

In the medium support unit 2 in the first embodiment, a heating portion is configured by one heater 13 and heating of the overall support surface 8 is turned ON and OFF (the temperature of the overall support surface 8 is changed) by turning ON and OFF the heater 13.

On the other hand, the medium support unit 2 in the embodiment includes a plurality of (12) heaters 13 and a heating region of the heaters 13 is divided into 12 regions of a region R1 to a region R12 on the support surface 8 and a temperature can be changed for every divided region. Therefore, the medium support unit 2 in the embodiment can heat only a necessary region at an appropriate temperature, thereby heating the necessary region of the support surface 8 while suppressing energy consumption.

Meanwhile, although the medium support unit 2 in the embodiment has the configuration in which the heating region of the heaters 13 is divided into 12 of the region R1 to the region R12, the number of divided regions is not particularly limited.

Figure 9:
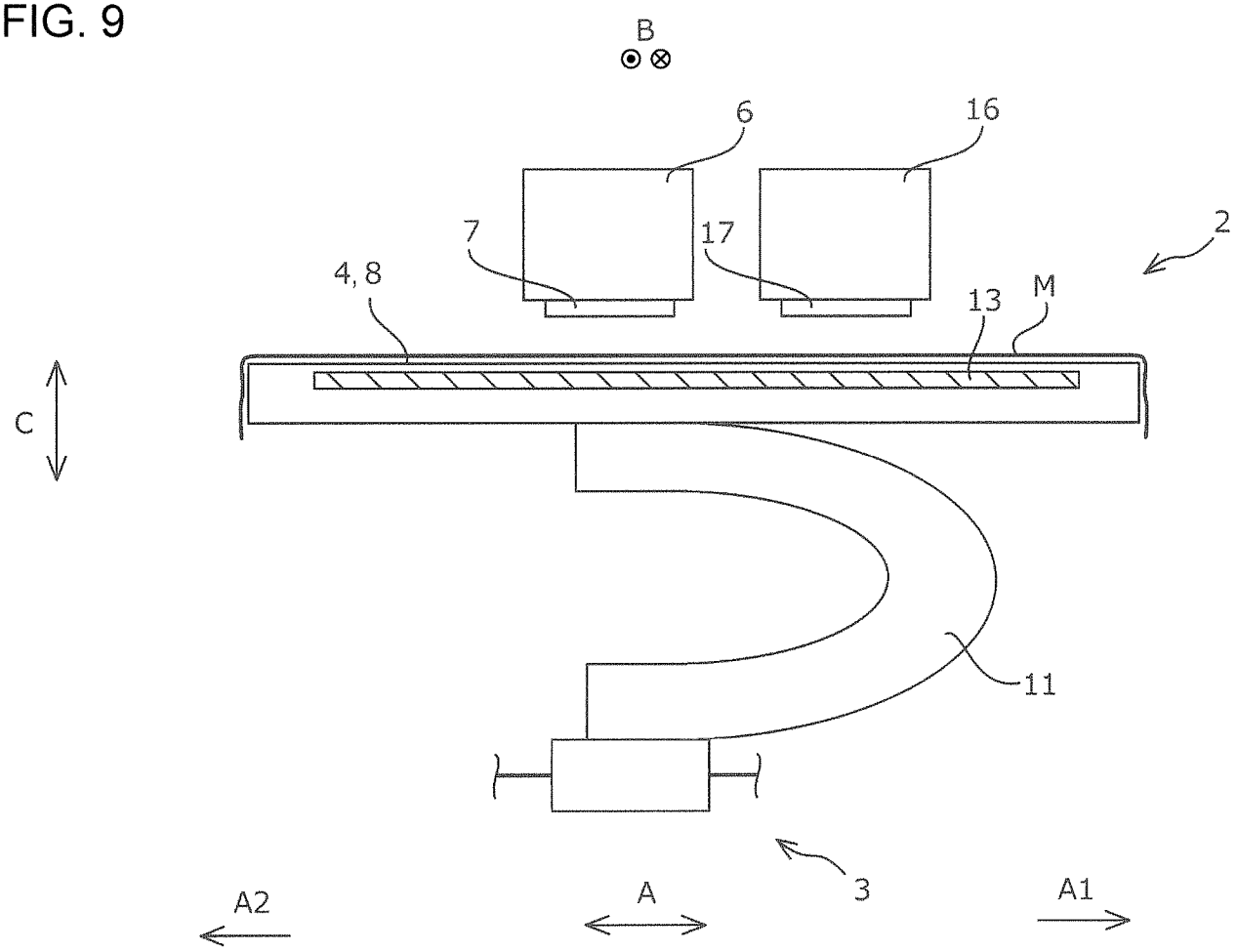
FIG. 9 is a schematic cross-sectional side view illustrating a main part of a printing apparatus according to a third embodiment of the invention.

Third Embodiment (FIG. 9)

Next, the printing apparatus 1 according to a third embodiment will be described in detail with reference to the accompanying drawing.

FIG. 9 is a schematic cross-sectional side view including a peripheral portion of the medium support unit 2 as a main part of the printing apparatus 1 in the third embodiment and is a view corresponding to FIG. 7 for the printing apparatus 1 in the first embodiment.

The printing apparatus 1 in the embodiment has the same configuration as that of the printing apparatus 1 in the first embodiment other than the configuration in which it can discharge a pretreatment agent and the same reference numerals denote the same constituent members as those of the printing apparatuses 1 in the first and second embodiments.

The printing apparatus 1 in the first embodiment includes the carriage 6 on which the printing head 7 is provided and can form an image on the medium M by causing the printing head 7 to discharge ink.

The printing apparatus 1 in the embodiment also includes the carriage 6 on which the printing head 7 is provided and can form an image on the medium M by causing the printing head 7 to discharge ink in the same manner as the printing apparatus 1 in the first embodiment. Note that the printing apparatus 1 in the embodiment can further discharge the pretreatment agent onto the medium M before the image is formed on the medium M by causing the printing head 7 to discharge ink. To be specific, the printing apparatus 1 in the embodiment includes a carriage 16 on which a pretreatment agent discharge head 17 capable of discharging the pretreatment agent is provided. The carriage 16 on which the pretreatment agent discharge head 17 is provided has the same configuration as the carriage 6 on which the printing head 7 is provided other than a point that it can discharge the pretreatment agent instead of the ink. The carriage 16 is however not limited to the above-described configuration, and, for example, the pretreatment agent may be applied with a roller.

Figure 10:
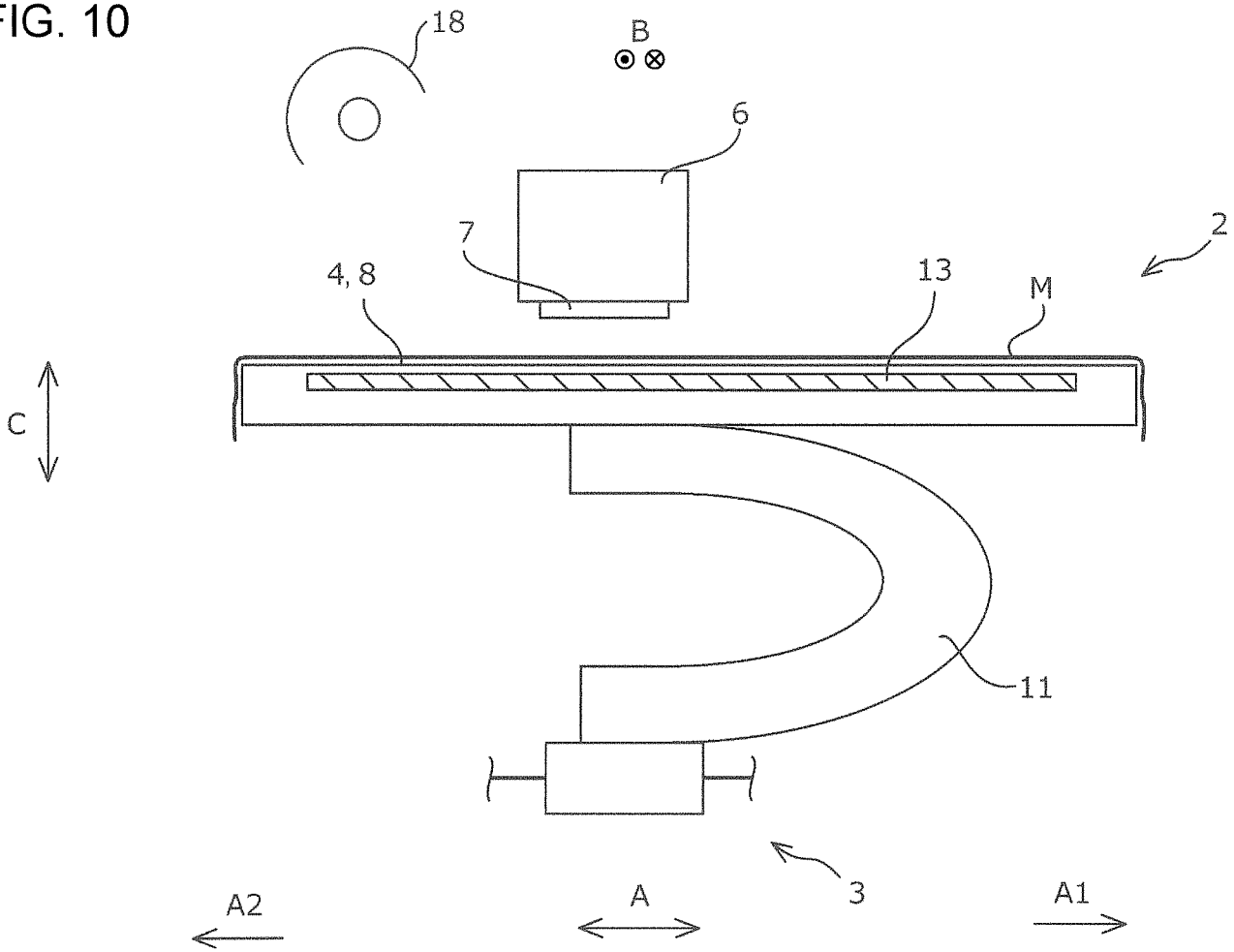
FIG. 10 is a schematic cross-sectional side view illustrating a main part of a printing apparatus according to a fourth embodiment of the invention.

Fourth Embodiment (FIG. 10)

Next, the printing apparatus 1 in the fourth embodiment will be described in detail with reference to the accompanying drawing.

FIG. 10 is a schematic cross-sectional side view including a peripheral portion of the medium support unit 2 as a main part of the printing apparatus 1 in the fourth embodiment and is a view corresponding to FIG. 7 for the printing apparatus 1 in the first embodiment.

The printing apparatus 1 in the embodiment has the same configuration as that of the printing apparatus 1 in the first embodiment other than a point that the printing apparatus 1 in the embodiment further includes a heating portion 18 in addition to the heater 13 provided in the medium support unit 2 and the same reference numerals denote the same constituent members as those of the printing apparatuses 1 in the first to third embodiments.

The printing apparatus 1 in the first embodiment includes, in the medium support unit 2, the heater 13 as a unit heating the medium M.

Although the printing apparatus 1 in the embodiment also includes, in the medium support unit 2, the heater 13 in the same manner as the printing apparatus 1 in the first embodiment, the printing apparatus 1 in the embodiment further includes the heating portion 18 capable of emitting infrared rays (electromagnetic waves) at a different position from the medium support unit 2. It should be noted that although the heating portion 18 in the embodiment has the configuration capable of emitting the infrared rays, it is not limited to the heating portion having the above-described configuration.

The invention is not limited to the above-described embodiments and various changes in a range of the invention described in the aspects of the invention can be made and it is needless to say that these changes are encompassed in the range of the invention.

This application claims priority under 35 U.S.C. § 119 to Japanese Patent Application No. 2016-043614, filed Mar. 7, 2016. The entire disclosure of Japanese Patent Application No. 2016-043614 is hereby incorporated herein by reference.

What is claimed is:

1. A medium support unit for supporting a medium on which a printing apparatus performs printing, the medium support unit comprising:

a support portion having a support surface for supporting the medium;

a heating portion heating the support portion;

a main body portion on which the support portion is mounted; and a frame portion capable of pressing the medium supported on the support portion by being mounted on a receiver provided on the main body portion, wherein heat conductivity of a mounting portion as a portion of the main body portion on which the support portion is mounted is lower than heat conductivity of the support portion.

2. The medium support unit according to claim 1, wherein the main body portion has the mounting portion and a non-mounting portion as a portion other than the mounting portion, which are made of different materials, and the heat conductivity of the mounting portion is lower than heat conductivity of the non-mounting portion.

3. A printing apparatus comprising:

the medium support unit according to claim 2; and a printing portion that performs printing on the medium supported on the medium support unit.

4. The medium support unit according to claim 1, wherein the main body portion has the mounting portion and a non-mounting portion as a portion other than the mounting portion, which are made of the same material.

5. A printing apparatus comprising:

medium support unit according to claim 4; and a printing portion that performs printing on the medium supported on the medium support unit.

6. The medium support unit according to claim 1, wherein the main body portion is provided with a hollow portion between an outer circumferential surface of the main body portion and the heating portion.

7. A printing apparatus comprising:

the medium support unit according to claim 6; and a printing portion that performs printing on the medium supported on the medium support unit.

8. The medium support unit according to claim 1, wherein the support portion is made of a highly heat conductive material having higher heat conductivity than heat conductivity of a material forming the main body portion.

9. A printing apparatus comprising:

the medium support unit according to claim 8; and a printing portion that performs printing on the medium supported on the medium support unit.

10. The medium support unit according to claim 1, wherein a heating region of the heating portion is divided on the support surface and a temperature is capable of being changed for every divided region.

11. A printing apparatus comprising:

medium support unit according to claim 10; and a printing portion that performs printing on the medium supported on the medium support unit.

12. A printing apparatus comprising:

the medium support unit according to claim 1; and a printing portion that performs printing on the medium supported on the medium support unit.

* * * * *